US006082543A

United States Patent [19]

Béliveau

[11] Patent Number: 6,082,543

[45] Date of Patent: Jul. 4, 2000

[54] PACKING PROTECTOR

[75] Inventor: Jean-Louis Béliveau, Magog, Canada

[73] Assignee: Polyform A.G.P. Inc., Granby, Canada

[21] Appl. No.: 09/454,971

[22] Filed: Dec. 6, 1999

[51] Int. Cl.[7] ..... B65D 85/30

[52] U.S. Cl. ..... 206/523; 206/591

[58] Field of Search ..... 206/453, 454, 206/523, 586, 591, 594

[56] References Cited

U.S. PATENT DOCUMENTS

| | | | |
|---|---|---|---|
| 4,440,304 | 4/1984 | Konopko | 206/586 |
| 4,883,179 | 11/1989 | Dionne | 206/523 |
| 4,938,360 | 7/1990 | Wallace | 206/586 |
| 5,090,571 | 2/1992 | Walker | 206/523 |
| 5,160,473 | 11/1992 | Bontrager | 264/138 |
| 5,204,328 | 4/1993 | Bontrager | 206/453 |
| 5,207,327 | 5/1993 | Brondos | 206/523 |
| 5,215,195 | 6/1993 | Williams | 206/523 |
| 5,307,928 | 5/1994 | Bishop | 206/320 |
| 5,348,157 | 9/1994 | Pozzo | 206/522 |
| 5,386,911 | 2/1995 | Payne | 206/591 X |
| 5,515,976 | 5/1996 | Moren et al. | 206/586 |

*Primary Examiner*—Jacob K. Ackun
*Attorney, Agent, or Firm*—Robic

[57] ABSTRACT

The packing protector is formed from an elongated strip of flexible cushioning material having an L-shaped cross section defining a vertical wall and a vertical wall. Transversal folding lines are provided in the strip to fold it in the shape of the packing protector. The folding line is formed by a groove spanning transversally on an inner side surface of the vertical wall. The groove is associated with a V-shaped folding cutout in the horizontal wall shaped to form two matching surfaces which are brought adjacent to each other when the strip is folded, thereby forming a unified wall. One of the two matching surfaces includes a male coupling interlockable with a female coupling in the other matching surface to keep the strip once folded in the form of the packing protector. A packing protector according to the present invention has the advantage of being easy and simple to ship to the user or purchaser in great amounts, as the unfolded strips can be easily piled up for the delivery. And once it is ready to be used, the strip has the advantage of being very easy and simple to be folded into the shape of the packing protector.

14 Claims, 3 Drawing Sheets

PACKING PROTECTOR

FIELD OF THE INVENTION

The present invention generally relates to packing protectors suitable for protecting packed fragile objects such as appliances, computer parts etc. commonly shipped in a box. More particularly, it relates to a packing protector formed from elongated strips of material.

BACKGROUND OF THE INVENTION

Packing protectors of different types are already commonly used to protect fragile items, such as appliances, computer parts, etc., during their shipment. There is the bubble wrapping where the object to protect is surrounded by a plastic film filled with air bubbles. There are also the protective pads made from folded corrugated paperboard blanks. An example of such protective pads is given in U.S. Pat. No. 4,440,304.

Also known in the prior art, there are the packing protectors made from blocks of plastic foam such as polyurethane cut to the exact exterior and interior configuration to fit within a carton box and to receive the fragile item. As can be easily understood, a lot of material is wasted during the making of those protectors, which makes their manufacturing very expensive. A solution to this problem of material wasting has been to propose packing protectors formed from foldable foam material. Examples of such protectors are given in U.S. Pat. Nos. 4,883,179; 5,024,328 and 5,160,473.

U.S. Pat. No. 4,883,179 discloses a packing member formed from an expanded plastic foam sheet. The packing member is formed by dividing the sheet into two legs by a V-shaped longitudinal groove. The surfaces of the foam sheet defining the V-shaped groove are coated with an adhesive to keep the packing member in shape once folded.

U.S. Pat. Nos. 4,888,179 and 5,024,328 in the name of Bontrager disclose a packaging frame formed from a blank including interior cuts and minimal cutouts. The blank is operably shifted to and form a single piece frame having an exterior quadrilateral to interfit with the interior of packing containers and having an interior perimeter to accommodate the reception of a part for shipment. Once removed from the container, the packing member disclosed by Bontrager goes back to its original unfolded state since there is nothing provided to keep the packing member in its folded shape.

Other examples of packing protector are given in U.S. Pat. Nos. 4,938,360; 5,090,571; 5,207,327; 5,307,928; 5,348,157; and 5,515,976.

There is still presently a need for a packing protector which will be simple to use by itself without requiring any other material such as glue, which will be economical to manufacture and easy to ship to the customers.

SUMMARY OF THE INVENTION

An object of the present invention is to propose a packing protector that will satisfy these above-mentioned needs.

According to the present invention, that object is achieved with a packing protector formed from an elongated strip of flexible cushioning material, the elongated strip having a cross section including an L-shaped portion defining a vertical wall and a horizontal wall. Each of the horizontal wall and vertical wall has an inner side surface opposite an outer side surface and, the strip comprises at least one transversal folding line allowing the strip to be folded to form the packing protector. The folding line is formed by a groove spanning transversally on the inner side surface of the vertical wall. The groove is associated with a generally V-shaped folding cutout in the horizontal wall shaped to form two matching surfaces which are brought adjacent to each other when the strip is folded, thereby forming a unified wall. One of the two matching surfaces includes a male coupling interlockable with a female coupling in the other matching surface to keep the strip once folded in the form of the packing protector.

The male coupling preferably consists of a tooth-like projection projecting from the matching surface and the female coupling preferably consists of a cavity shaped to receive the tooth-like projection and thus form a joint.

As can be appreciated, a packing protector according to the present invention has the advantage of being easy and simple to ship to the user or purchaser in great amounts as the unfolded strips can be easily piled up for the delivery. And once it is ready to be used, the strip has the advantage of being very easy and simple to be folded into the shape of the packing protector, and thanks to the male and female coupling, the packing protector remains in shape once folded without requiring any other tool or adhesive material.

A non-restrictive description of a preferred embodiment of the invention will now be given with reference to the appending drawings.

DESCRIPTION OF A PREFERRED EMBODIMENT

Figure 1:
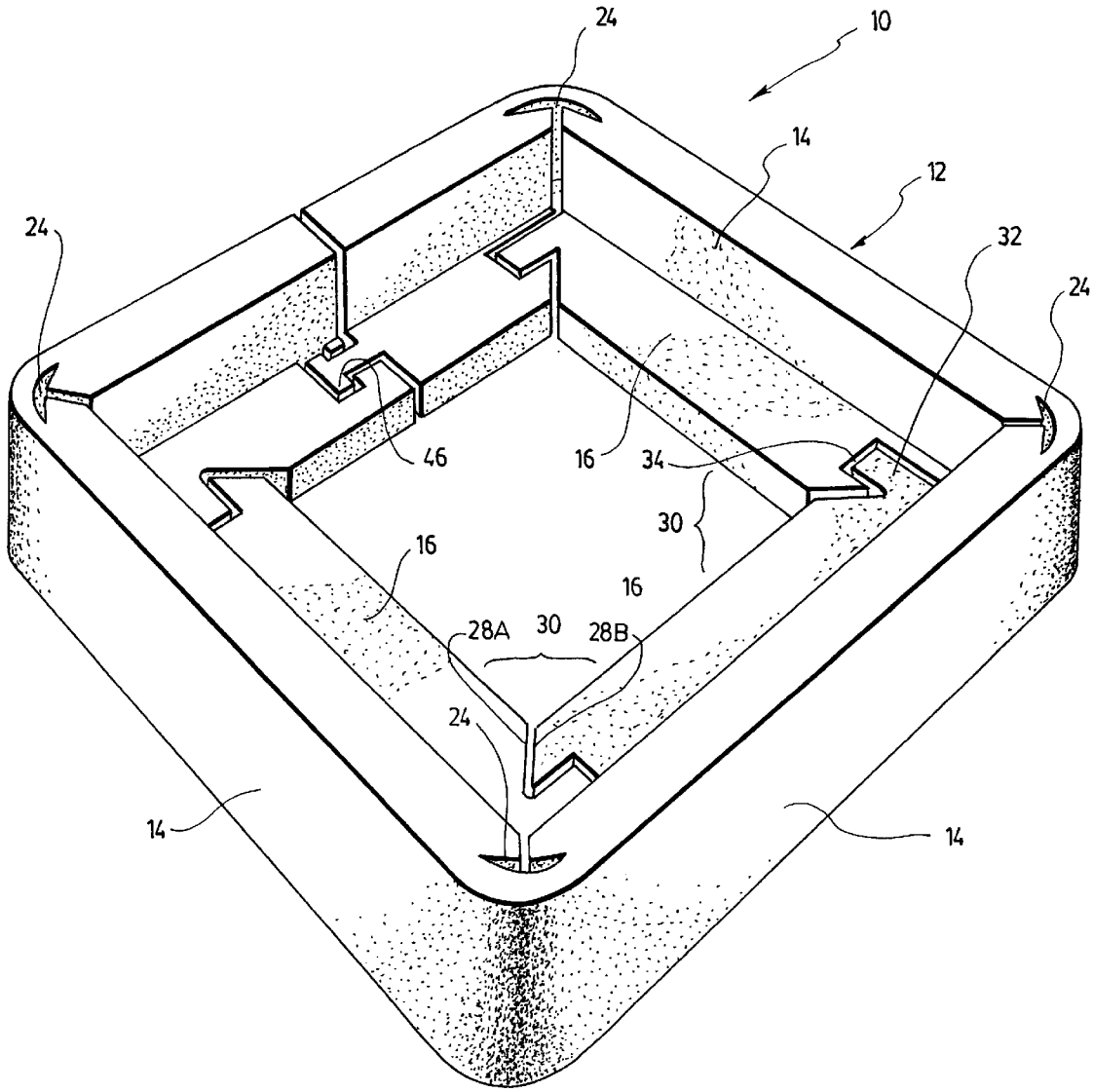
FIG. 1 is a perspective top view of a packing protector according to the present invention having the shape of a partly bottomless box.

Referring to FIG. 1, a packing protector (10) according to the present invention may have the shape of a rectangular box. However, it may take a lot of other shapes such as a simple corner protector or any other polygonal shape as a triangle, a heptagon, hexagon etc.

Figure 2:
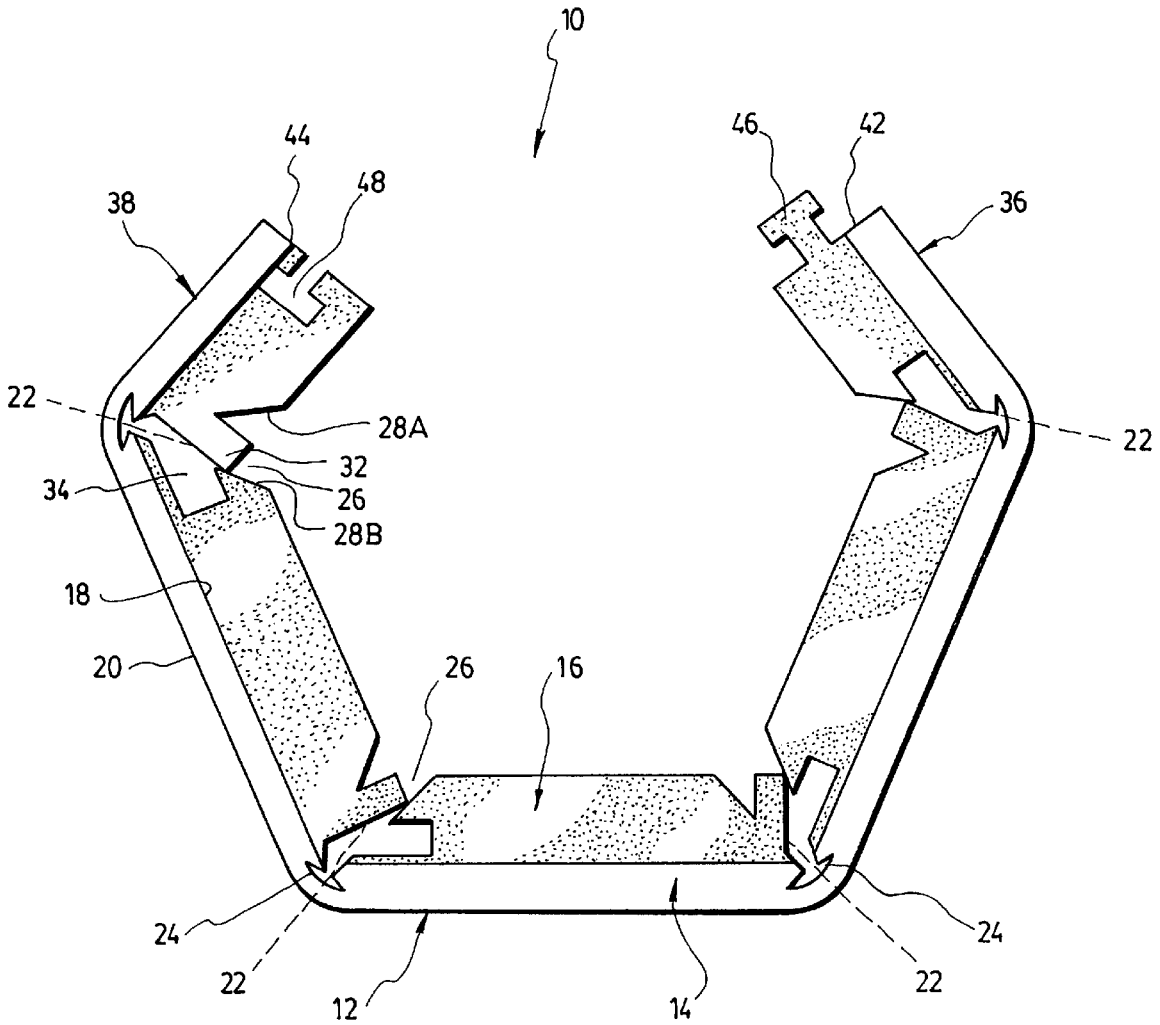
FIG. 2 is a top view of the packing protector of FIG. 1 shown in partially folded state.
Figure 3:
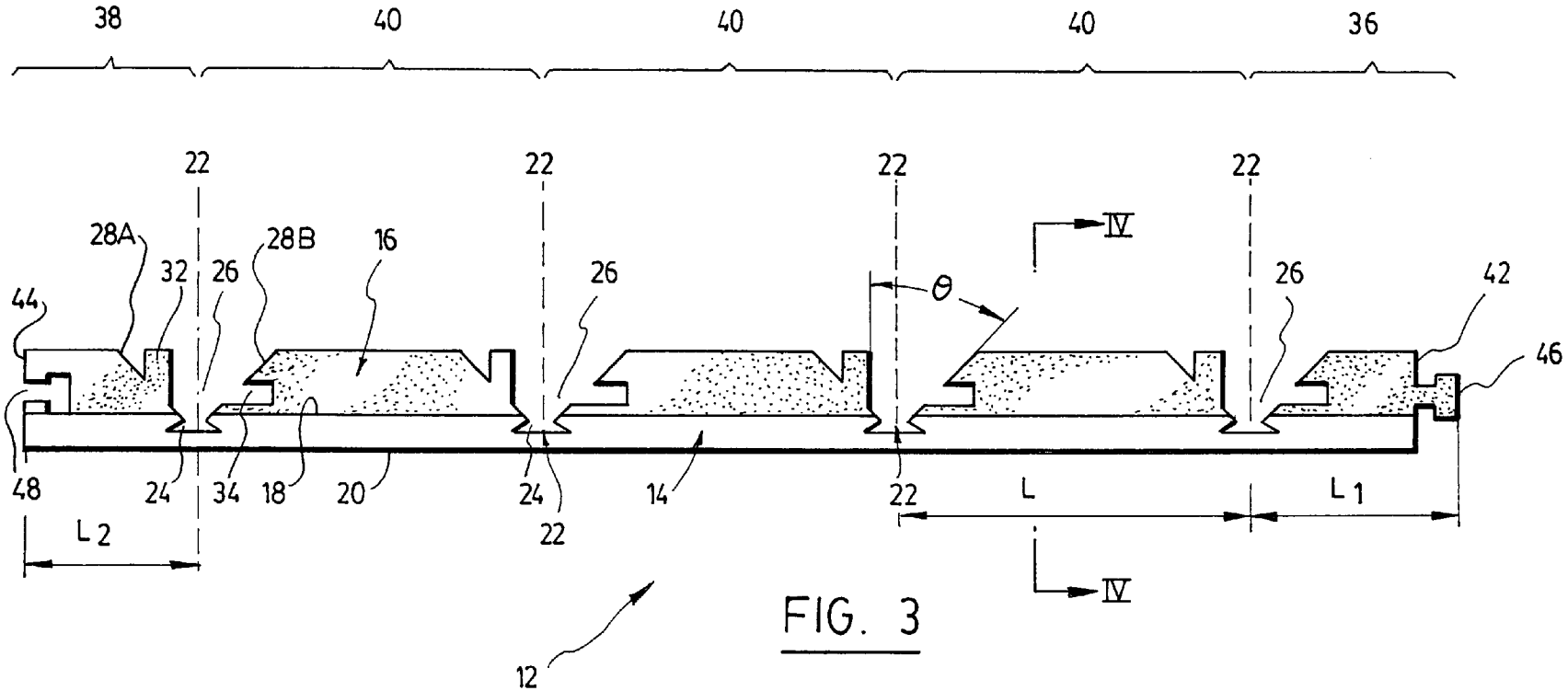
FIG. 3 is a top view of the elongated strip of material used to form the packing protector of FIG. 1.
Figure 4:
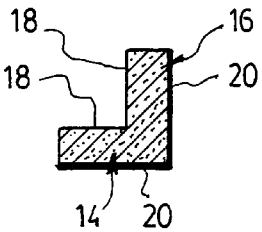
FIG. 4 is a cross-sectional side view of the strip shown in FIG. 3, which is taken along line IV—IV.

Referring also to FIGS. 2 to 4, the packing protector (10) is formed from an elongated strip (12) of flexible cushioning material, which is preferably a plastic foam material such as polypropylene and polyethylene. This elongated strip (12) has an L-shaped cross section defining a vertical wall (14) and a horizontal wall (16), each having an inner side surface (18) opposite an outer side surface (20). The strip (12) comprises at least one transversal folding line (22) allowing the strip (12) to be folded to form the packing protector (10). The preferred embodiment illustrated comprises four of those folding lines (22). However, it has to be understood that a packing protector according to other embodiments of the invention may have more or less than four folding lines depending on the shape desired. For example, a simple corner protector would only have one folding line and a U-shaped protector would have two folding lines.

As best seen from FIG. 2 or 3, each folding line (22) is formed by a groove (24) spanning transversally on the inner side surface (18) of the vertical wall (14). This groove (24) is associated with a generally V-shaped folding cutout (26) in the horizontal wall (16). This cutout (26) is shaped to form two matching surfaces (28A, 28B) which are brought adjacent to each other when the strip (12) is folded, thereby forming a unified wall (30), as shown in FIG. 1. The groove (24) is preferably fan-shaped and disposed at the tip of the V-shaped cutout (26), as best seen in FIG. 3.

In order to keep the strip (12) once folded in the shape of the packing protector (10), one of the two matching surfaces (28A) defined in the horizontal wall (16) includes a male coupling (32) interlockable with a female coupling (34) in the other matching surface (28B). As illustrated, the male coupling (32) may preferably consist of a tooth-like projection projecting from the matching surface (28a) and the female coupling (34) then consists of a cavity shaped to receive the tooth-like projection (32) and thus form a joint.

As best seen from FIGS. 1 and 2, to form the packing protector (10), the strip (12) is folded at the folding lines (22), then the strip (12) is twisted or bent in order to insert the tooth-like projection (32) into the cavity (34). The formed protector (10) thus remains in shape.

In the preferred embodiment, the V-shaped folding cutout (26) of the folding lines (22) has an opening angle (θ) of 45°, as indicated on one of the cutouts (26) illustrated in FIG. 3, such that the packing protector (10) has the shape of a square corner at the folding lines (22). Different shapes of packing protectors according to the present invention may be obtained by varying the opening angle of the V-shaped cutout (26).

In order to obtain a packing protector (10) having the shape of a bottomless box as illustrated in FIG. 1, the strip (12) comprises at least three folding lines (22) dividing the strip (12) into a plurality of sections including a right end section (36) opposite a left end section (38) and at least one middle section (40) therebetween, as indicated in FIG. 3, and the V-shaped folding cutout (26) of each folding line has an opening angle (θ) calculated so as to allow the end surface (42) of the right end section (36) and the end surface (44) of the left end section (38) to join up when the strip (12) is folded at each folding line (22). For example, the preferred embodiment illustrated, which has the shape of a square box, contains three of those middle sections (40) having the same length (L). As can be appreciated, the sum of the length ($L_1$) of the right end section (36) and the length ($L_2$) of the left end section (38) equals the length (L) of one middle section (40). Thus with an opening angle of 45 degree for each cutout (26), the packing protector formed with such a strip (12) has the shape of a square box.

It has to be understood that by varying the opening angle (θ) of the cutouts (26) and the length of the different sections of the strip (12), it is possible to obtain a multitude of different packing protectors according to the present invention.

In the case of a strip suitable to form a box-shaped protector, the strip (12) preferably comprises a connecting means to securely connect the right end section (36) with the left end section (38). The connecting means preferably comprises a tenon-like projection (46) formed at the end surface (42) of the right end section (36) and interlockable with a mortise-like cavity (48) formed at the end surface (44) of the left end section (38). Both the tenon-like projection and the mortise-like cavity preferably have a T shape.

In another preferred embodiment of the invention, not illustrated, the cross section of the strip (12) may be U-shaped, thereby defining one vertical wall and two horizontal walls. In that case, the groove of each folding line would be associated with a V-shaped cutout formed in each of the horizontal walls.

The necessary shape of a strip (12) according to the present invention may advantageously be cut by a hot wire process or any other known method used to shape plastic foam materials.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

What is claimed is:

1. A packing protector formed from an elongated strip of flexible cushioning material, the elongated strip having a cross section including an L-shaped portion defining a vertical wall and a horizontal wall, each of the horizontal wall and vertical wall having an inner side surface opposite an outer side surface, the strip comprising at least one transversal folding line allowing the strip to be folded to form the packing protector, said at least one folding line being formed by a groove spanning transversally on the inner side surface of the vertical wall, said groove being associated with a generally V-shaped folding cutout in the horizontal wall shaped to form two matching surfaces which are brought adjacent to each other when the strip is folded, thereby forming a unified wall, one of said two matching surfaces including a male coupling interlockable with a female coupling in the other matching surface to keep the strip once folded in the form of the packing protector.

2. A protector as claimed in claim 1, wherein the male coupling consists of a tooth-like projection projecting from said one matching surface and the female coupling consists of a cavity shaped to receive the tooth-like projection and thus form a joint.

3. A packing protector as claimed in claim 1, wherein said V-shaped folding cutout of said at least one folding line has a 45 degree opening angle such that the packing protector has the shape of a square comer at said at least one folding line.

4. A packing protector as claimed in claim 1, wherein the strip comprises at least three of said folding lines dividing the strip into a plurality of sections including a right end section opposite a left end section and at least one middle section therebetween, and wherein the V-shaped folding cutout of each folding line has an opening angle calculated so as to allow an end surface of the right end section and an end surface of the left end section to join up when the strip is folded at each folding line, whereby the packing protector has the shape of a box.

5. A packing protector as claimed in claim 4, comprising a connecting means to securely connect the right end section with the left end section.

6. A packing protector as claimed in claim 5, wherein the connecting means comprises a tenon-like projection formed at the end surface of the right end section interlockable with a mortise-like cavity formed at the end surface of the left end section.

7. A packing protector as claimed in claim 6, wherein the tenon-like projection and the mortise-like cavity have a T shape.

8. A strip of flexible cushioning material for forming a packing protector, the strip having a cross section including an L-shaped portion defining a vertical wall and a horizontal wall, each of the horizontal wall and vertical wall having an inner side surface opposite an outer side surface, the strip comprising at least one transversal folding line allowing the strip to be folded to form the packing protector, said at least one folding line being formed by a groove spanning transversally on the inner side surface of the vertical wall, said groove being associated with a generally V-shaped folding cutout in the horizontal wall shaped to form two matching surfaces which are brought adjacent to each other when the strip is folded, thereby forming a continuous bottom wall of the packing protector, one of said two matching surfaces including a male coupling interlockable with a female coupling in the other matching surface to keep the strip once folded in the form of the packing protector.

9. A strip of flexible cushioning material as claimed in claim 8, wherein the male coupling consists of a tooth-like projection projecting from said one matching surface and the female coupling consists of a cavity shaped to receive the tooth-like projection and thus form a joint.

10. A strip of flexible cushioning material as claimed in claim 8, wherein said V-shaped folding cutout of said at least one folding line has a 45 degree opening angle such that the packing protector formed has the shape of a square comer at said at least one folding line.

11. A strip of flexible cushioning material as claimed in claim 8, wherein the strip comprises at least three of said folding lines dividing the strip into a plurality of sections including a right end section opposite a left end section and at least one middle section therebetween, and wherein the V-shaped folding cutout of each folding line has an opening angle calculated so as to allow an end surface of the right end section and an end surface of the left end section to join up when the strip is folded at each folding line, whereby the packing protector formed has the shape of a box.

12. A strip of flexible cushioning material as claimed in claim 11, comprising a connecting means to securely connect the right end section with the left end section.

13. A strip of flexible cushioning material as claimed in claim 12, wherein the connecting means comprises a tenon-like projection formed at the end surface of the right end section interlockable with a mortise-like cavity formed at the end surface of the left end section.

14. A packing protector as claimed in claim 13, wherein the tenon-like projection and the mortise-like cavity have a T shape.

* * * * *